United States Patent [19]

Wallace

[11] 4,037,329

[45] July 26, 1977

[54] SHUTTER AND SYSTEM EMPLOYING SAME

[75] Inventor: Sydney Johnstone Wallace, Point Roberts, Wash.

[73] Assignee: American Can Company, Greenwich, Conn.

[21] Appl. No.: 657,955

[22] Filed: Feb. 13, 1976

[51] Int. Cl.[2] ..... F26B 3/28; F27D 5/00

[52] U.S. Cl. ..... 34/4; 34/7; 34/231; 432/65

[58] Field of Search ..... 34/7, 4, 231, 55; 432/64, 65

[56] References Cited

U.S. PATENT DOCUMENTS

| | | | |
|---|---|---|---|
| 245,491 | 8/1881 | Hegeler | 432/65 |
| 3,021,125 | 2/1962 | Stuchbery | 432/64 |
| 3,831,289 | 8/1974 | Knight | 34/7 |
| 3,849,063 | 11/1974 | Eichenlaub | 34/4 |

*Primary Examiner*—John J. Camby

*Attorney, Agent, or Firm*—Robert P. Auber; Ira S. Dorman; George P. Ziehmer

[57] ABSTRACT

A shutter, adapted for use in a system for the radiation curing of a line of articles, includes a number of adjacent baffle units, the blades of which are configured and spaced to substantially prevent the passage of radiation, while permitting the flow of air through the shutter. To minimize the tendency of thermal expansion to distort the shutter, the units are expandably mounted along the length of the supporting frame, and the blades extend transversely thereof.

15 Claims, 3 Drawing Figures

SHUTTER AND SYSTEM EMPLOYING SAME

BACKGROUND OF THE INVENTION

Systems for radiation curing or drying of articles and, in particular, ultraviolet curing of printed or coated can bodies, are well known in the art. Typically, they consist of an ultraviolet generating lamp and a conveyor for moving the wet bodies along an irradiated travel path.

During temporary stoppages or shutdown periods, it is desirable to maintain the UV lamps in an operating mode, so as to minimize curing lag when operation resumes. However, to prevent over-curing of the stationary can bodies exposed to the lamp during such periods, it has been the practice to shield the bodies by means of an air- or water-cooled, solid shutter. Unfortunately, the prior art shutters have been found to be unsatisfactory in some respects, and in particular because they block air circulation to the lamp, thus preventing heat dissipation and thereby diminishing the life of the lamp and the efficiency of its operation. Moreover, warpage due to thermal expansion has been a rather serious problem with such equipment.

Accordingly, it is an object of this invention to provide a novel shutter which serves as a highly effective light barrier, while permitting the free flow of air therethrough.

It is also an object of this invention to provide such a novel shutter which is of reduced susceptibility to the adverse effects of heat and, in particular, distortion caused by thermal expansion, and is of relatively simple construction, durable, and readily- and easily-operable.

It is still another object of this invention to provide a novel system for effecting the radiation curing of conveyed articles and, in particular, the UV-curing of can bodies, in which such a novel shutter of the foregoing description may be employed.

It is yet another object of this invention to provide such a system which is relatively simple, durable, dependable and efficient in operation.

SUMMARY OF THE INVENTION

It has now been found that certain of the foregoing and related objects of the invention are readily attained in a shutter, which includes an elongated frame and a plurality of baffle units, each of which units is comprised of a multiplicity of blades disposed at spaced locations along its length and extending thereacross. The units are expandably mounted adjacent one another along the length of the frame, and the blades thereof extend transversely of the frame. The configuration and spacing of the blades substantially prevents the passage of radiation through the shutter, whilepermitting the flow of air therethrough, and the expandable mounting of the blade units and the transverse disposition of the blades minimize the tendency of thermal expansion to distort the shutter.

In a preferred embodiment, each of the blades has a trough-like configuration, and the blades in each of the units are disposed in a partially-nested relationship to one another. Most advantageously, the blades in each of the units are equidistantly spaced, with the last blades of each unit being partially nested within the first blades of the unit adjacent it to thereby provide a uniform, partial-nested relationship of the blades along the entire length of the shutter. Most desirably, each of the blades is of generally V-shaped cross-section. In the particularly preferred embodiments, each of the baffle units is independently mounted on the frame, such as by mounting means centrally located on the two transverse sides thereof and engaged with the frame.

Certain objects of the invention are also attained in a system for curing a plurality of articles by radiation, which employs the shutter of the foregoing description. The system further includes means for conveying a plurality of articles along a travel path, and radiation-generating means, which preferably generates ultraviolet radiation, adjacent the conveying means and disposed for irradiation of the travel path. The shutter is mounted for movement into and out of interposition between the generating means and the travel path and means is provided for so moving the shutter.

Additionally, the system includes control means responsive to the conveying means, for activating the moving means, so as to effect appropriate positioning of the shutter with respect to the generating means and the travel path. Preferably, the control means activates the moving means to interpose the shutter between the generating means and the travel path, in response to stoppage of the conveying means. Generally, the conveying means will be adapted to transport can bodies along the travel path, and also to permit rotation of the bodies during such conveyance.

DETAILED DESCRIPTION OF THE ILLUSTRATED EMBODIMENT

Figure 1:
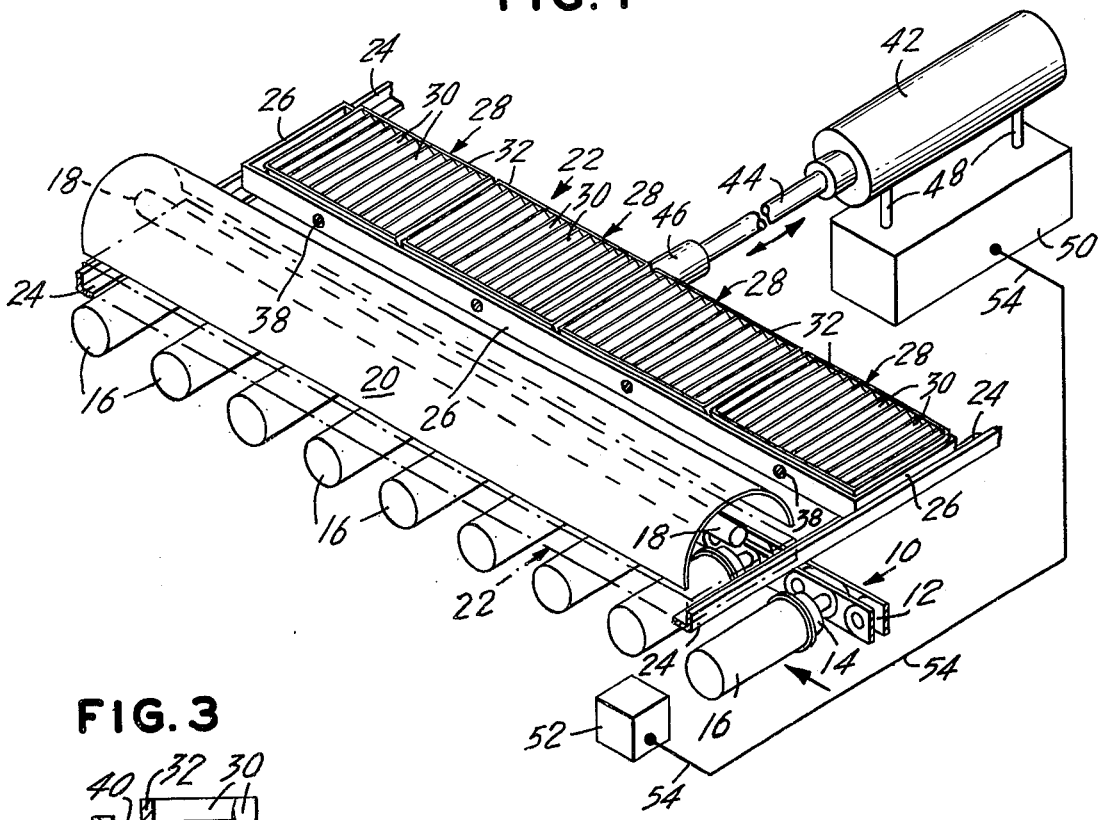
FIG. 1 is a diagrammatical perspective view of a radiation curing system embodying the present invention, showing in full line the shutter in a non-shielding, withdrawn position, and in phantom line the shutter in an interposed, shielding position.
Figure 3:
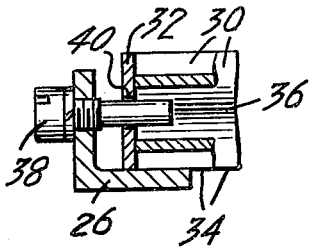
FIG. 3 is a cross-sectional view along lines 3—3 of FIG. 2, showing the means for mounting the baffle units on the frame.

Turning now in detail to the appended drawing, therein illustrated is a system embodying the present invention, and including a conveyor, generally designated by the numeral 10. The conveyor 10 comprises an endless chain 12 (only a portion of which is shown), mounted for movement (by means not shown) along a generally horizontal travel path, and being driven by suitable means (also not shown). The conveyor supports a plurality of can holders 14, which are rotatably mounted at spaced intervals on the chain 12 and are adapted to securely mount thereon a can shell 16 to permit (such as by interference means, not shown) rotation of the bodies 16 during their conveyance.

An ultraviolet generating lamp 18 is disposed above, and extends generally along a portion of, the travel path traversed by the can shells 16; in cooperation with the reflector 20, disposed directly above it, the lamp 18 serves to efficiently irradiate the wet surfaces of the can shells 16, as they pass thereunder, to effect the cure of the material coated thereon.

Figure 2:
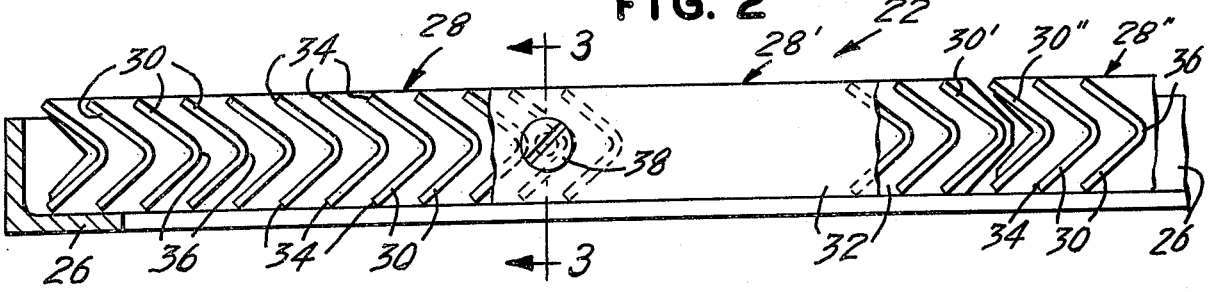
FIG. 2 is a fragmentary side elevational view, drawn to an enlarged scale, of the shutter of the system of FIG. 1, with portions broken away to show the disposition of the blades in the baffle units, and also the relative position of two adjacent units.

As illustrated in FIG. 1, a shutter, generally designated by the numeral 22, is supported at its end by a pair of track members 24 (in turn supported by means not shown), for horizontal reciprocable movement between a lamp shielding position (shown in phantom line), with the shutter interposed between the lamp 18 and the line of shells 16, and a withdrawn, non-shielding position (shown in full line). The shutter 22 is comprised of an elongated, substantially rectangular frame 26, and four baffle units, each generally designated by the numeral 28, disposed adjacent to one another along the length of the frame 26. As can be seen most clearly in FIG. 2, each of the units 28 consists of a multiplicity of parallel, transversely-extending blades 30 of generally V-shaped cross-section, which are joined at each of their ends to side plates 32. The blades 30 are equidistantly spaced, and are disposed in a partially-nested relationship, wherein the edges 34 of one blade 30 extend at least to, and preferably beyond, the nose or apex 36 of the blade 30 adjacent to it. As will be appreciated, the disposition, spacing and configuration of the blades 30 will block the transmission of light through the shutter 22 while permitting the free flow and circulation of air therethrough.

Each of the baffle units 28 is independently secured in the frame 26 by a pair of mounting pins 38 projecting through the frame 26 and into the holes 40, which are formed at about the center of each side plate 32. As can be seen best in FIG. 2, the last blade 30' of one unit 28' is partially-nested within the first blade 30'' of the adjacent unit 28''; because all of the units are so related, a uniform, partially-nested relationship of the blades 30 is provided along the entire length of the shutter 22, in turn affording a continuous, gap-free radiation shield. It should also be appreciated that, because of the mounting method employed, the units 28 are free to expand in both directions from the mounting pins 38 (spacing, of course, being adequate for that purpose); this feature, together with the disposition of the blades 30 cross-wise (rather than length-wise) in the shutter 22, significantly reduce the susceptibility of the shutter 22 to distortion fromthermal expansion.

Movement of the shutter 22 is effected pneumatically, by a piston 44, driven from the cylinder 42 and attached to the shutter frame 26 by the end fixture 46. They cylinder 42 is connected through lines 48 to an electro-pneumatic control mechanism 50 which regulates the flow of air from a pressurized source thereof (not shown), and releases the air, as appropriate.

A sensor 52, such as a proximity switch or a photoelectric cell, is positioned adjacent the conveyor 10, and is adapted to monitor its movement. As herein depicted, when the conveyor 10 stops, an appropriate signal is generated in the sensor 52 and sent by way of cable 54 to the control mechanism 50, in turn to actuate the cylinder 42 and effect interposition of the shutter 22 between the lamp 18 and the travel path; resumption of conveyor movement will cause retraction of the shutter 22 to the non-shielding position illustrated.

While the instant system and shutter have been described in relation to the illustrated and preferred embodiment, it should be understood that modifications may be made, as will be apparent to those skilled in the art. For example, while it is preferred that the shutter be moved pneumatically, this may be accomplished by other equivalent means known in the art. In addition, it should be appreciated that the monitoring of conveyor movement and actuation and control of shutter movement may be effected by a variety of equivalent devices and mechanisms well known in the art.

Insofar as shutter design and construction are concerned, it should be noted that blade configuration and disposition may be substantially modified, as long as the light-shielding and air transmission characteristics of the shutter are afforded. For example, flat, overlapping or interleaved blades may be substituted for the chevron-shaped blades illustrated. Mounting of the baffle units may also be accomplished in numerous ways, so long as adequate expansion of the units, without undue distortion of the shutter is accommodated. Finally, because of the rather high temperatures normally involved, the shutter will generally be fabricated from metal; however, under some circumstances other materials may be feasible.

Thus, it can be seen that the present invention provides a novel shutter which serves as a highly effective light barrier, while permitting the free flow of air therethrough. The shutter is of reduced susceptibility to the adverse effects of heat and, in particular, to distortion caused by thermal expansion; it is of relatively simple construction, durable, and readily-employed. Generally, the shutter will be used in a unique system for effecting the radiation curing of conveyed articles; specifically, a system for the UV-curing of can bodies is afforded, which is relatively simple, durable, dependable and efficient in operation.

What ic claimed is:

1. A shutter comprising: an elongated frame; and a plurality of individual baffle units, each of said units being comprised of a multiplicity of overlappingmutually spaced blade means disposed along the length of said unit and extending thereacross to provide a radiation barrier while permitting passage of air therebetween, headers supporting said blade means at their opposite ends, and means engaging said headers to mount said units adjacent one another along the length of said frame and accommodating thermal expansion thereof, confronting blade means of adjacent units overlapping one another to provide a radiation barrier while permitting passage of air therebetween with said blade means extending transversely of said frame, the recited disposition and configuration of said baffle units being effective to prevent the passage of radiation through said shutter while permitting the flow of air therethrough, and the recited disposition of said blade means in combination with the recited expandable mounting of said baffle units in said frame minimizing the tendency of thermal expansion to distort said shutter.

2. The shutter of claim 1 wherein each of said blade means is of generally trough-shaped configuration, and wherein the blade means in each of said units are disposed in partially-nested relationship to one another.

3. The shutter of claim 2 wherein the blade means in each of said units are equidistantly spaced, and wherein the confronting blade means of adjacent units are partially-nested within one another, to thereby provide a uniform, partially-nested relationship of said blade means along the length of said shutter.

4. The shutter of claim 2 wherein each of said blade means is of generally V-shaped cross-section.

5. The shutter of claim 1 wherein said means to mount said baffle units is so located as to engage said frame and a central portion of each header, so that each said baffle unit is independently mounted on said frame.

6. The shutter of claim 5 wherein each of said means to mount said baffle units comprises means defining a pin and a pin-receiving aperture on confronting regions of said frame and each said header.

7. In a system for curing a plurality of articles by radiation, the combination comprising: conveying means operative to move a plurality of articles along a travel path; radiation-generating means adjacent said conveying means and disposed for irradiation of said travel path; a shutter, comprising an elongated frame and a plurality of individual baffle units, each of which is comprised of a multiplicity of overlapping mutually spaced blade means disposed along the length of said unit, extending thereacross, and supported at their opposite ends on provided corresponding header means to provide a radiation barrier while permitting passage of air therebetween, means engaging said header means to mount said units adjacent one another along the length of said frame and accommodating thermal expansion thereof, and confronting blade means of adjacent units overlapping one another to provide a radiation barrier while permitting passage of air therebetween with said blade means extending transversely of said frame, the disposition of said baffle units being effective substantially to prevent the passage of radiation through said shutter while permitting the flow of air therethrough, and the recited disposition of said blade means in combination with expandable mounting of said baffle units in said frame minimizing the tendency of thermal expansion to distort said shutter, said shutter being mounted for movement into and out of interposition between said generating means and said travel path; means for so moving said shutter; and control means responsive to changes in movement by said conveying means for activating said shutter moving means, to effect appropriate positioning of said shutter with respect to said generating means and said travel path.

8.The system of claim 7 wherein each of said blade means is of trough- shaped configuration, and wherein the blade means in each of said units are disposed in partially-nested relationship to one another.

9. The system of claim 8 wherein the blade means in each of said units are equidistantly spaced, and wherein the confronting blade means of adjacent units are partially-nested within one another, to thereby provide a uniform, partially-nested relationship of said blade means along the length of said shutter.

10. The system of claim 8 wherein each of said blade means is of a generally V-shaped cross-section.

11. The system of claim 7 wherein each of said means to mount said baffle units is so located as to engage said frame and a central portion of each header, so that each said baffle unit is independently mounted on said frame.

12. The system of claim 11 wherein each of said means to mount said baffle units comprises means defining a pin and a pin-receiving aperture on confronting regions of said frame and each said header.

13. The system of claim 7 wherein said generating means is operative to generate ultra-violet radiation.

14. The system of claim 13 wherein said control means activates said moving means, to interpose said shutter between said generating means and said travel path, in response to stoppage of movement by said conveying means.

15. The system of claim 14 wherein said conveying means is adapted to transport can bodies along said travel path, and to permit rotation of the bodies during such transport.

* * * * *